United States Patent [19]

Ashby et al.

[11] 4,306,511

[45] Dec. 22, 1981

[54] APPARATUS FOR THE FASTENING TOGETHER OF SHEET MATERIALS

[75] Inventors: George S. Ashby, Port Credit; Andrew S. Zakrzewski, Burlington, both of Canada

[73] Assignee: Dofasco Inc., Hamilton, Canada

[21] Appl. No.: 99,762

[22] Filed: Dec. 3, 1979

[51] Int. Cl.[3] ..... B23P 11/00

[52] U.S. Cl. ..... 113/1 N; 29/521

[58] Field of Search ..... 29/715, 521, 798, 432.2, 29/432, 243.5, 283.5; 113/1 N, 116 Y, 116 CC, 116 FF

[56] References Cited

U.S. PATENT DOCUMENTS 3,885,299 5/1975 Hafner ..... 29/432.2 X 3,900,937 8/1975 Schleicher ..... 29/521 X

*Primary Examiner*—Mark Rosenbaum

*Attorney, Agent, or Firm*—Rogers, Hirons & Scott

[57] ABSTRACT

Apparatus for the fastening together of two or more sheets of material by means of an integral fastener consists of a longitudinally-movable pierce and extrusion punch, a cooperating longitudinally-movable pierce and curl die, and a segmented extrusion die surround the pierce and curl die. The pierce and extrusion punch and the pierce and curl die cooperate to pierce a hole through the sheets, and the punch and the segmented extrusion die then cooperate to push the material of one sheet through the other to form two coaxial tubes; thereafter the pierce and curl die curls the pushed-through material of the coaxial tubes back to effect the fastening, the apparatus providing a stationary anvil to cooperate with the pierce and curl die. The punch and the curl die are engaged by the ends of respective pivoted levers by which they are moved, and other ends of the levers being connected together; the ratio provided by the two levers differs so that the punch moves further and faster than the curl die. In a particular embodiment providing an increased gap between the punch and its cooperating die the punch is in two parts which move relative to one another, the extrusion portion being latched in its neutral position. In a further embodiment the punch and cooperating die lance out a portion of cruciform shape, the sheets surrounding the lanced part being extruded to interlock with the lanced part and form the fastener.

19 Claims, 19 Drawing Figures

FIG. 3A
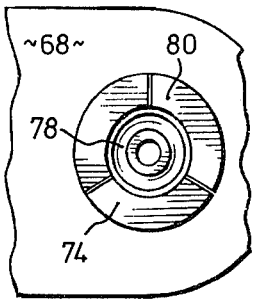
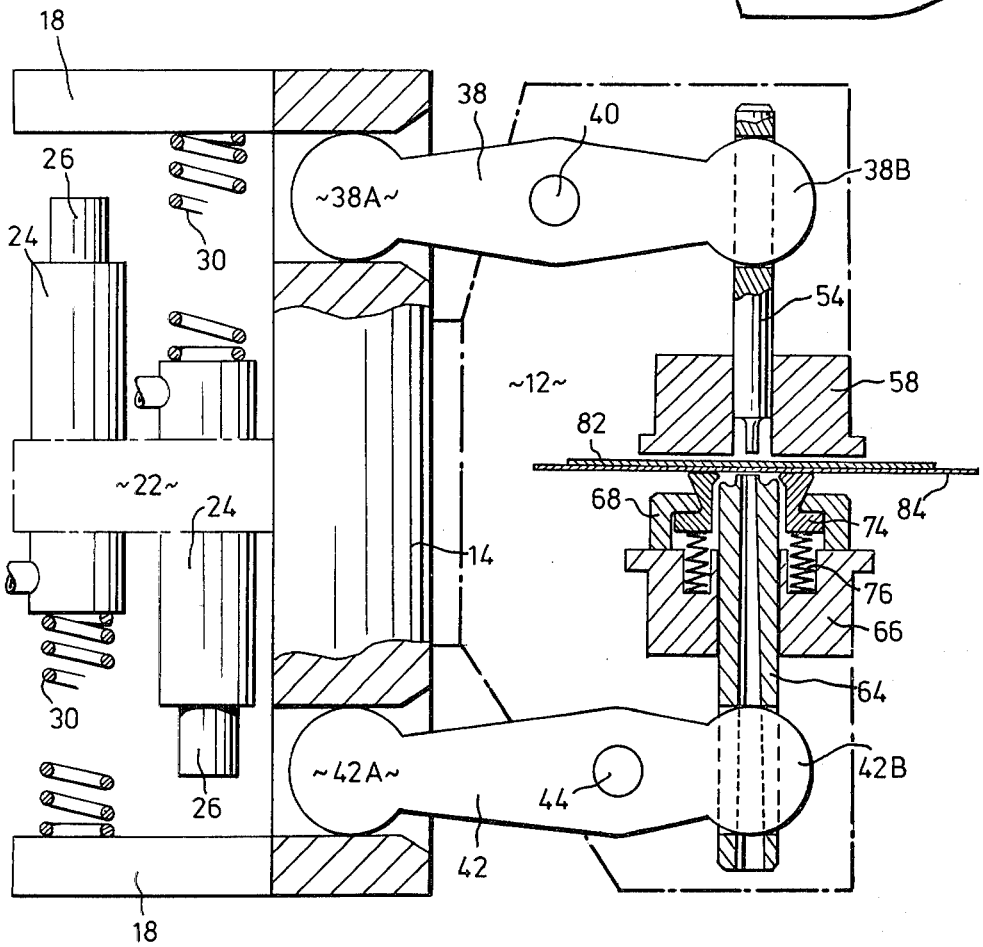
FIG. 4

APPARATUS FOR THE FASTENING TOGETHER OF SHEET MATERIALS

FIELD OF THE INVENTION

The present invention is concerned with improvements in or relating to apparatus for the fastening together of sheet materials by means of an integral fastener, that is to say apparatus by which two or more sheets of material can be joined together using part of one of the sheets as the fastener.

REVIEW OF THE PRIOR ART

The integral fastening together or two or more pieces of sheet materials is of course well known, and in one such system registering tabs or flaps are struck out simultaneously from the superimposed sheets and then bent until they lie parallel to the adjacent sheet. Such an integral fastener can be produced by a single relatively simple operation, but structurally is not particularly strong or secure, especially in directions transverse to the flap fold line. In another system a hole is pierced through the two superimposed sheets, and the portions of the sheets surrounding the hole are then bent down and back to provide an integral fastener that is equally strong in both directions. The second system therefor produces a more desirable fastener, but to the best of our knowledge required two or more separate mechanical operations for its completion.

An integral fastening system has the intrinsic advantages that the fastener is produced from the sheet material and that the joining of two or more sheets is largely independent of their surface finish and/or type of material so that, for example, dissimilar materials may also be joined by use of this system. The system however is in competition with other systems, such as spot welding, which produce an all-around strong fastening and which require only a single operation. Another potential desirable attribute of an integral system is the possibility of making the apparatus completely portable, and, for thinner sheet material, even independent of an external power source, the operator supplying the motive power; it is virtually essential in that case for the fastening to take place with a single mechanical operation if it is to be accepted in commercial practice.

DEFINITION OF THE INVENTION

It is therefore an object of the invention to provide new apparatus for fastening sheet material together using an integral fastener, and particularly such apparatus with which the fastening can be effected by a single mechanical operation.

In accordance with the present invention there is provided an apparatus for the fastening together of two superimposed sheets of material using an integral fastener comprising:

an apparatus body, a punch member mounted by the body for movement along a longitudinal axis toward and away from a sheet receiving station, an extrusion die member surrounding the said longitudinal axis for cooperation with the punch member upon engagement of the latter with sheet material at the sheet receiving station to form the engaged portion of the sheet material to a cylindrical formation, a curl die member mounted by the body for movement along the said longitudinal axis toward and away from the sheet receiving station and engageable with the said cylindrical formation to curl the sheet portions back toward the adjacent sheet and thereby form a fastening between them, and means for moving the punch member into engagement with the sheet material and for moving the curl die member into engagement with the cylindrical formation subsequent to the said engagement of the punch member.

Preferably, the movement of the curl die member to curl the cylindrical formation is accompanied by movement of the extrusion die member to an inoperative position.

The extrusion die may be of a segmented form surrounding the said longitudinal axis and the curl die member is engageable with the segmented die member upon its movement for curling the cylindrical formation to move the segments radially outward to an inoperative position.

Preferably, the said punch member comprises a nose portion of a smaller diameter for piercing the sheet material and a forming portion of larger diameter for extruding the portion of the sheet material to a cylindrical formation, and the two portions may be movable relative to one another, the nose portion being movable in a bore in the forming portion.

DESCRIPTION OF THE DRAWINGS

Fastenings which are particular preferred embodiments of the present invention will now be described, by way of example, with reference to the accompanying diagrammatic drawings wherein:

FIG. 3A is a section taken on the line 3A—3A of FIG. 3, FIGS. 4 through 8 are similar schematic figures illustrating the successive steps by which an apparatus in accordance with the invention carries out a single fastening operation, the drawings having been simplified and some parts having been omitted when not necessary for simplicity in illustration.

DESCRIPTION OF THE PREFERRED EMBODIMENTS

Figure 1:
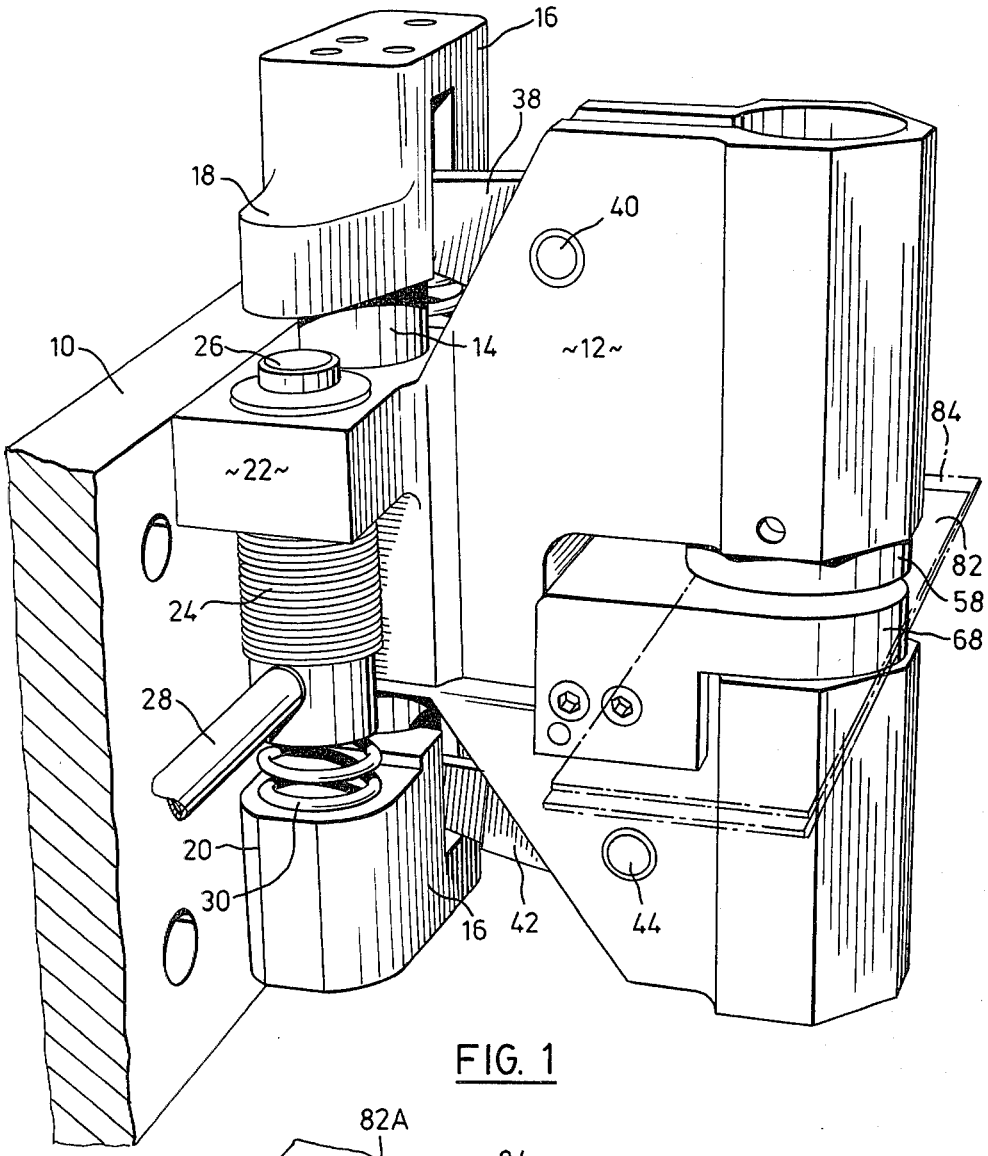
FIG. 1 is a perspective view of a first embodiment.
Figure 2:
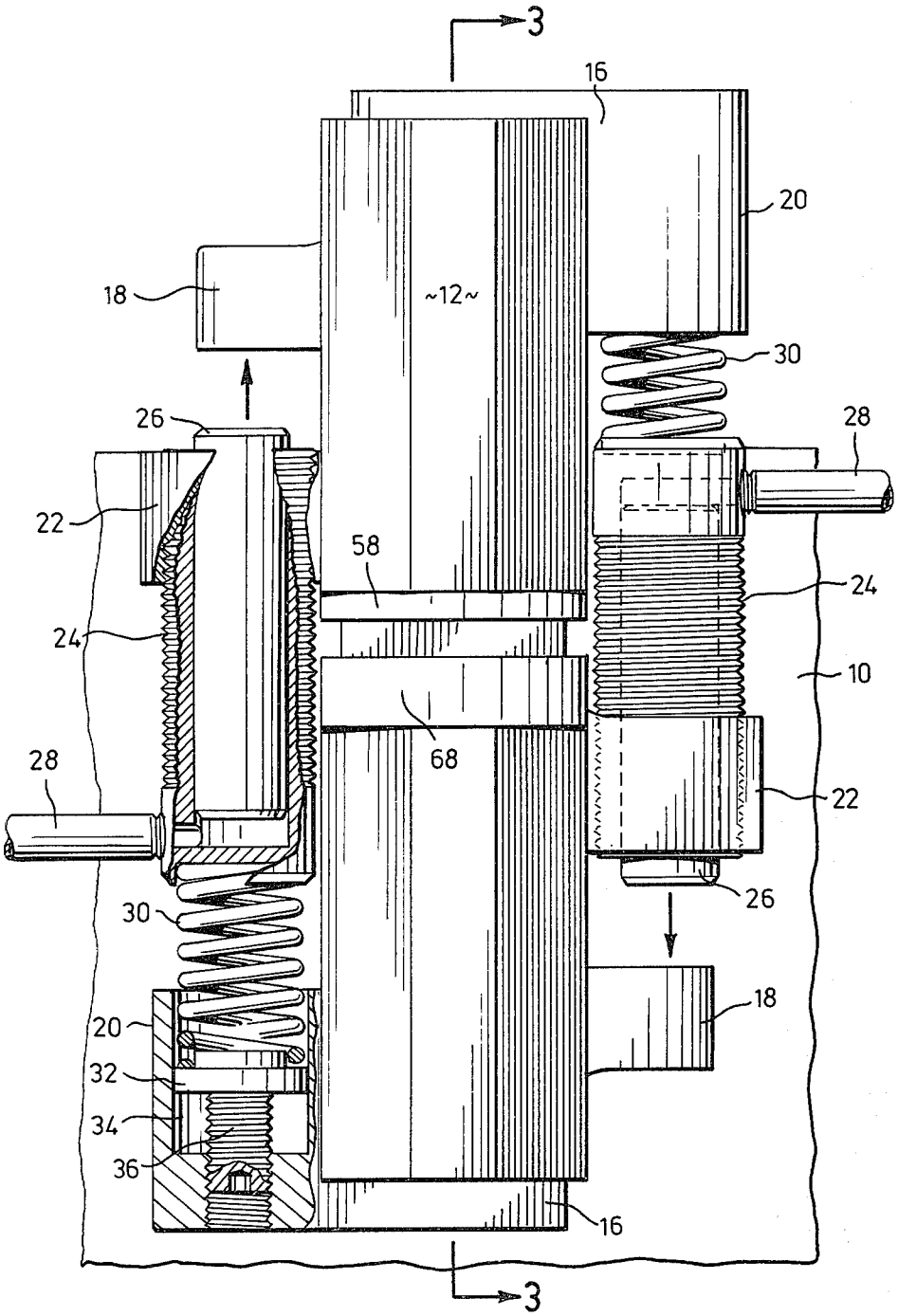
FIG. 2 is a front elevation of the apparatus of FIG. 1, parts being shown broken away for clarity of illustration.
Figure 3:
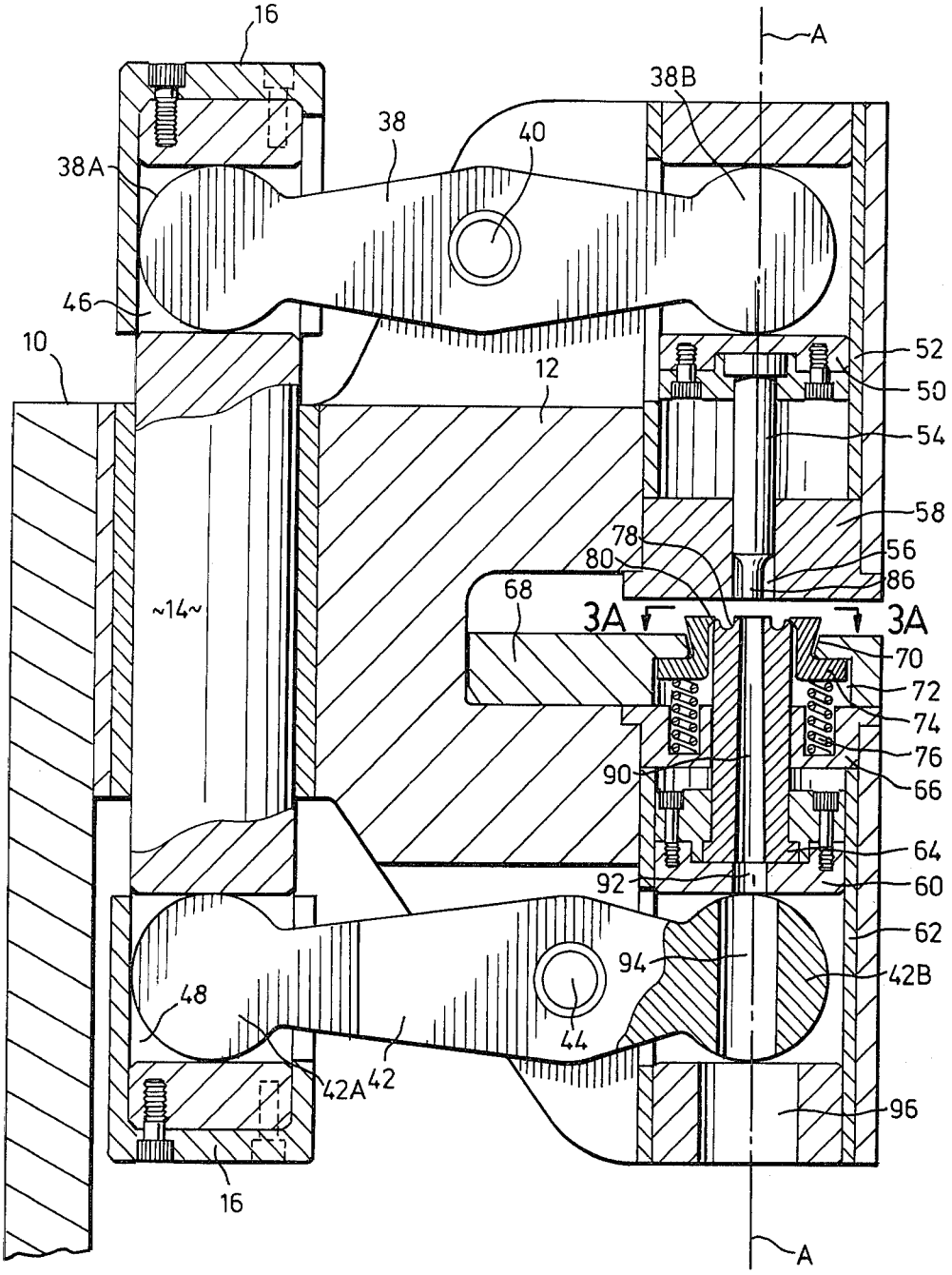
FIG. 3 is a longitudinal cross-section generally on the line 3—3 of FIG. 2, with some parts not in section for simplicity and clarity of illustration.
Figure 5:
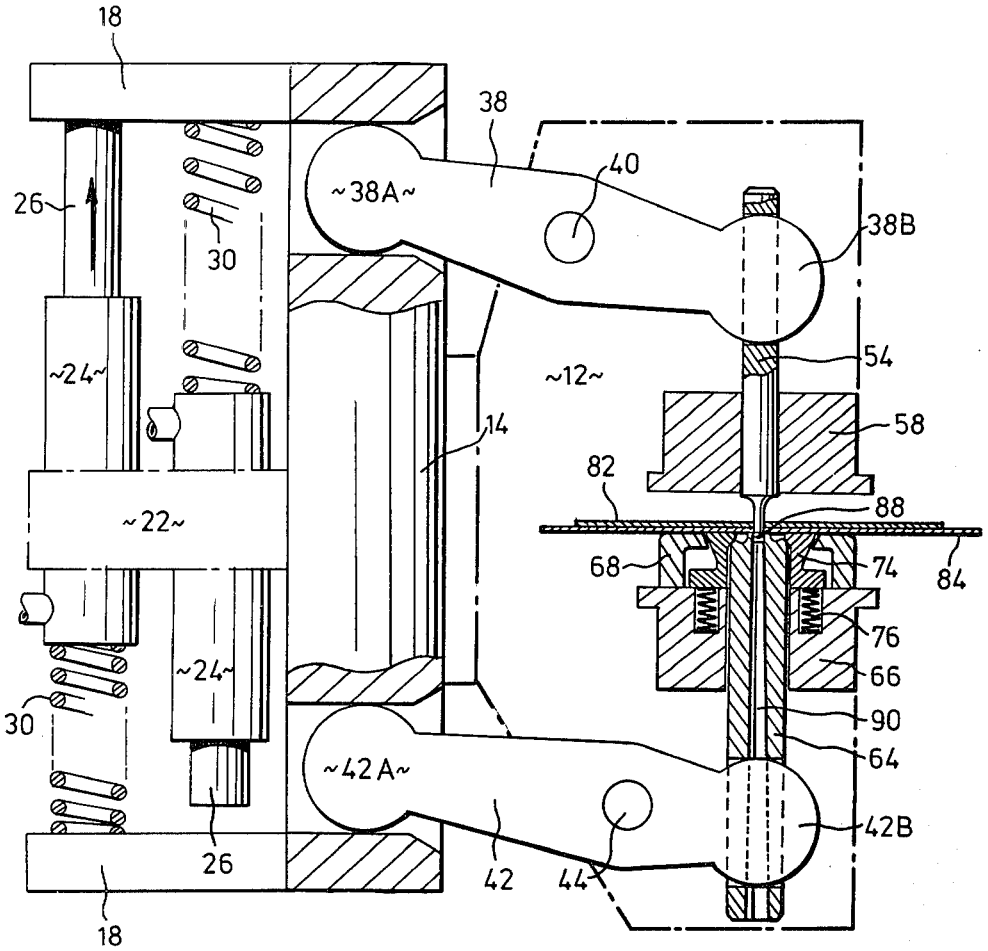

The apparatus of FIG. 1–8 is illustrated in FIGS. 1–3 only as mounted on a vertical support plate 10. The apparatus comprises a machined body 12 in and on which the various other elements of the apparatus are mounted. Thus a coupling rod member 14 is mounted in a bore in the body for free sliding back and forth movement; for convenience in description this will be described as an up-and-down movement, since this corresponds with the attitude of the apparatus as shown in the drawings, but the apparatus is equally operative in any attitude in which it may be placed, for example when in completely portable form. The coupling rod 14 is provided at each end with a removable cap 16 having opposed side extensions 18 and 20, disposed so that side extension 18 of one cap is opposite to the side extension 20 of the other cap. The body 12 is provided with two flanges 22, each disposed between two opposite extensions 18 and 20, and each flange receives a hydraulic cylinder 24 having a piston 26 and supplied with pressurized operating liquid via a pipe 28 to produce movement of the piston in the direction of the arrow. A compression spring 30 is interposed between each cylinder 24 and a shoulder washer 32 (FIG. 2), the latter being movable in a bore 34 in the respective extension 18 under the action of a grub screw 36 to determine the compression of the spring. The two opposed springs are arranged to hold the coupling rod member 14 in a central or neutral position shown in FIGS. 1 through 4.

An upper two-armed lever 38 is pivoted to the body about a pivot pin 40, while a lower two-armed lever 42 is pivoted to the body about a pivot pin 44, the rounded ends 38A and 42A of the levers being engaged in slots 46 and 48 respectively in the upper and lower ends of the coupling rod member 14. The other end 38B of the lever 38 is engaged with and moves an upper pierce and extrude punch structure up and down along a longitudinal axis A—A (FIG. 3 only), while the other end 42B of the lever 42 is engaged with and moves a lower pierce and curl die structure up and down along the same longitudinal axis. The two levers are of the same length and it will be noted that the pivot pin 40 is disposed approximately midway between the lever ends 38A and 38B, while the pivot pin 44 is disposed much closer to the end 42B than to the end 42A so that any movement of the coupling rod 14 produces a more rapid movement, and one of greater excursion, for the pierce punch structure than for the pierce and curl die structure.

The upper pierce punch structure consists of a piston 50 having the lever end 38B engaged therewith, the piston being freely slidable in a sleeve 52. A punch member 54 is secured to the piston 50 and is guided for accurate longitudinal movement by its engagement in a bore 56 in an upper anvil member 58.

The lower pierce and curl die structure is somewhat more complex and consists of a piston 60 having the lever end 42B engaged therewith and freely slidable in a sleeve 62, the upper end of the piston 60 having a curl die member 64 fastened thereto. The curl die is guided for longitudinal movement along the same axis as the punch member 54 by its engagement in a bore in a bushing 66. An extrusion die retaining member 68 is fastened to the body 12 and has a tapered bore 70 and larger diameter counterbore 72 therein coaxial with the longitudinal axis of the curl die 58. A three-part segmented extrusion die 74 (see also FIG. 3A) of approximately L-shaped radial cross-section is mounted around the curl die for movement therewith or independently thereof, as will be explained below. Each segment of the die is urged upward by a respective compression spring 76 engaged between the lower horizontal leg of the segment and the bushing 68, these springs being required primarily when the machine is used in other than the vertical position.

The upper end of the curl die has an annular recess 78 therein shaped to curl a metal edge that it engages outwards and back upwards, as will be described below. The circular upper outer edge of the curl die member 64 is engageable with a radially-inwardly projecting ridge 80 at the upper end of the segmented die 74, so that upward movement of the curl die 64 causes corresponding upward movement of the extrusion die 74. The maximum upward movement of the segmented die 74 under the urge of the springs 76 or, if the springs are not used, by the engagement of ridge 80 with the outer circular edge of the curl die 64, is set by the engagement of the horizontal legs of the die segments with the bottom of counterbore 72. The cylindrical surface of the bore 70 and the adjacent radially outermost cylindrical surface of the die segments 74 are of complementary shape, being of increasing radius upwards, and constitute cooperating cam surfaces causing the segments to move radially inwards with downward movement relative to the retaining member 68, and permitting the segments to move radially outwards again as they are raised by the curl die 64 and/or springs 76.

Figure 1A:
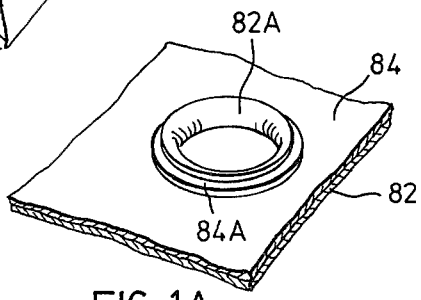
FIG. 1A is a perspective view from below of a typical fastening produced by the apparatus of FIG. 1.

The operation of the apparatus can now be described. The apparatus can be employed to form a smooth-surfaced grommet aperture in a single sheet, but its principal purpose is of course to fasten together two sheets 82 and 84 of ductile material, usually metal, by an integral circular fastener as illustrated by FIG. 1A. The space between the members 58 and 68 constitutes a sheet receiving station at the start of an operation. FIG. 4 shows the coupling rod 14 centered with the pierce and extrude punch 54 fully withdrawn upwards into the bore 56, while the pierce and curl die 64 is level with the segmented extrusion die, which is in its maximum upward position. The coupling rod 14 is now moved forcibly upward by engagement of the respective piston rod 26 with the extension 18 of the upper cap 16. The punch 54 moves quickly downward, while the curl die 64 moves more slowly downward, the pierce punch engaging the sheets 84 and 84 and pushing them downward, thereby pushing downward the extrusion die segments 74 to their lowermost position, if they have not already been moved downward by the weight of the sheets, the segments simultaneously moving radially inwards by the cam action between their outer faces and the face of the bore 70. The small diameter piercing end part 86 of the punch 54 now pierces the sheets and the resultant separated slugs 88 (FIG. 5) of material fall from the apparatus via bores 90, 92, 94 and 96 of progressively increasing diameter respectively in the curl die 64, piston 60, lever end 42B and piston 60 again.

Figure 6:
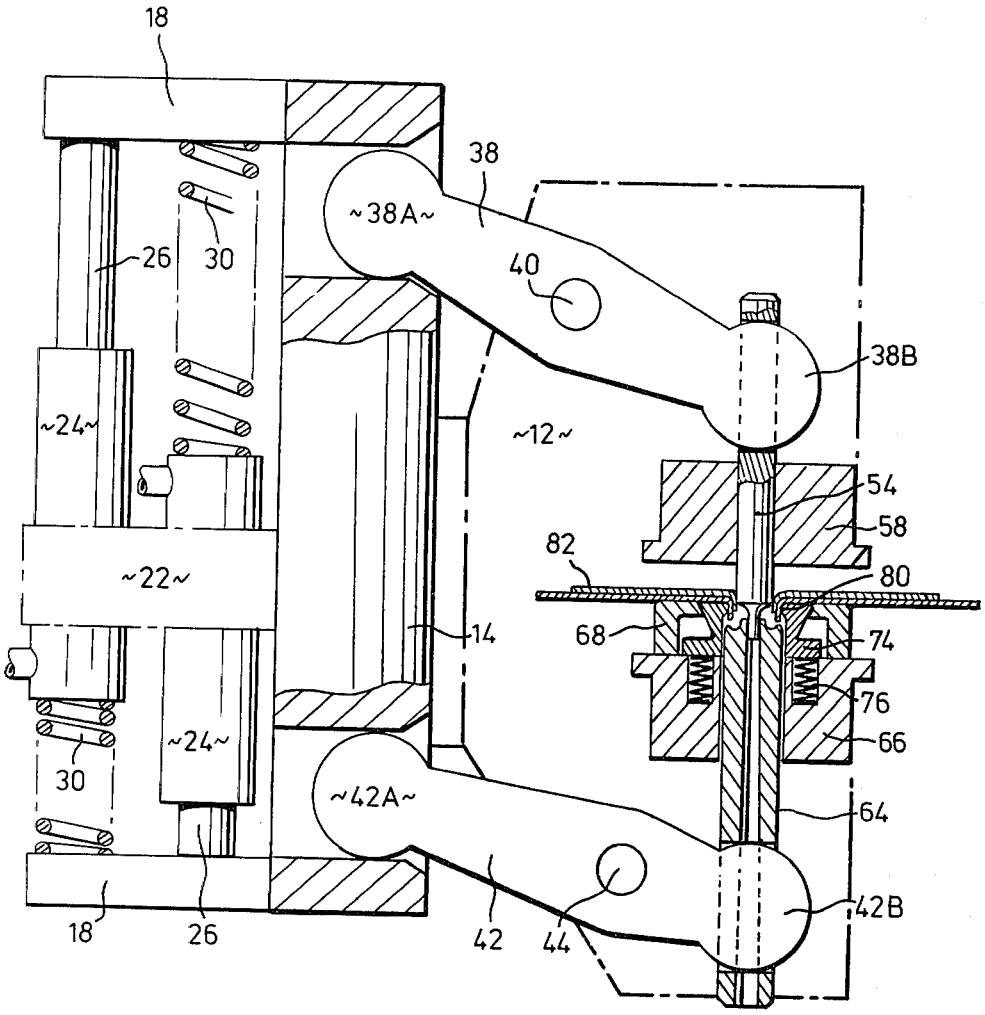
Figure 7:
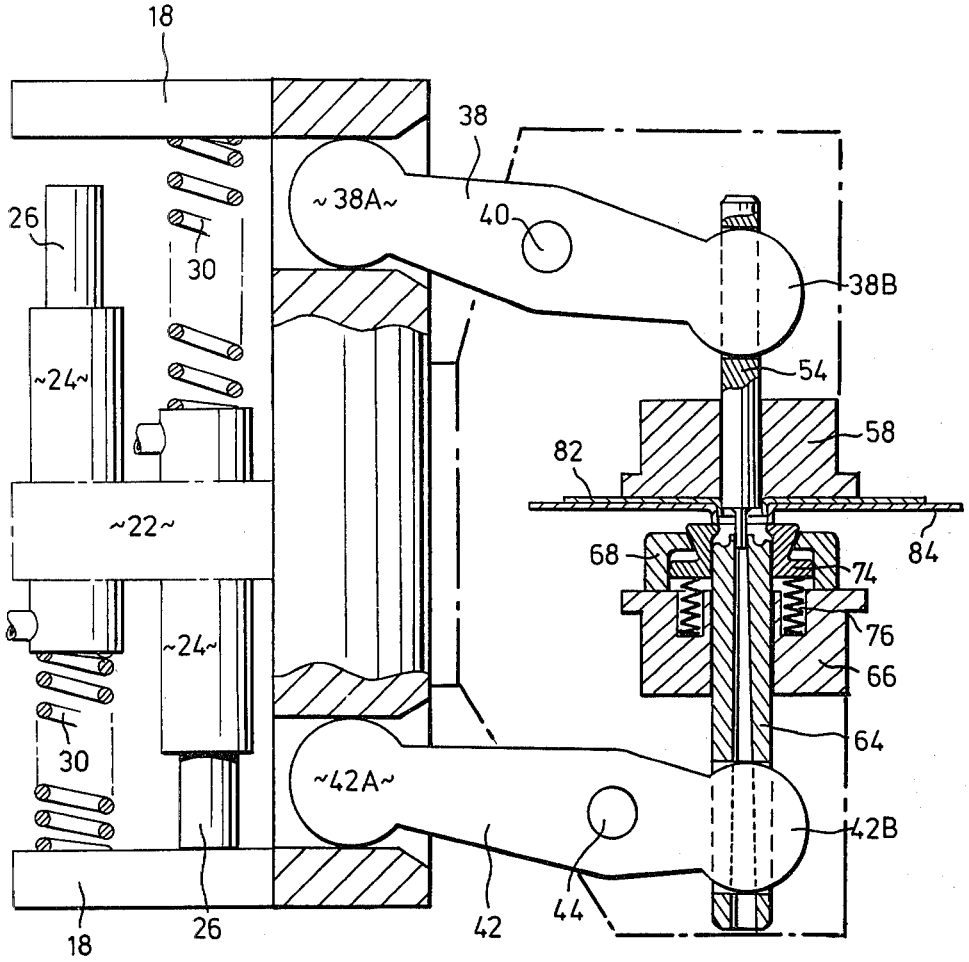
Figure 8:
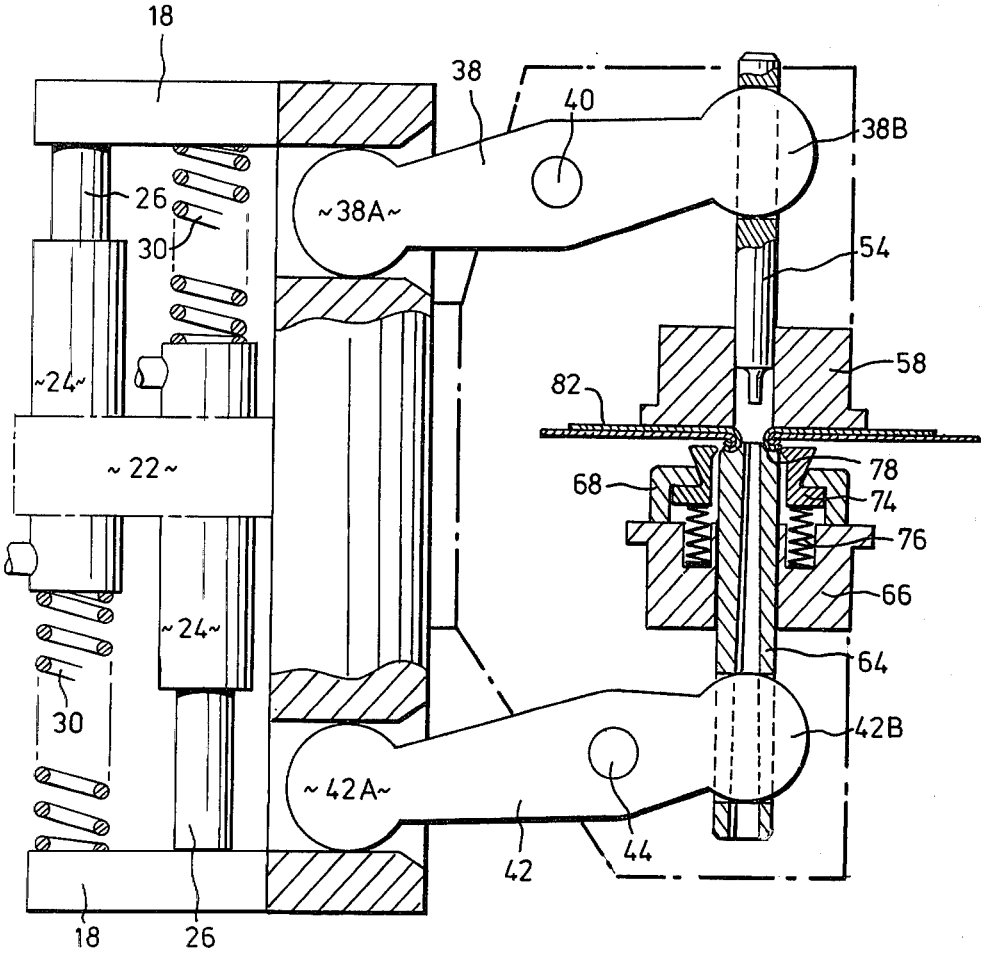

Referring now to FIG. 6, the pierce punch continues its downward movement and the larger diameter part thereof now passes through the sheets and forms two coaxial cylindrical portions by an extrusion operation against the circular radial ridge 80 of the segmented die member 74. This concludes the upward stroke of the respective piston 26 and the other piston 26 is now actuated to produce a downward stroke of the coupling rod 14, while the first-mentioned piston is withdrawn. FIG. 7 shows the initial result of this upward stroke and it will be seen that the pierce and extrude punch 54 has withdrawn from the pierce and curl die 64, carrying with it the workpiece sheets 82 and 84 and the die segments 74 have moved upwards but not yet radially-outwards. The workpieces are positively stripped from the punch by their engagement with the anvil member 58. FIG. 8 shows the conclusion of the upward stroke where the pilot nose of the curl die 64 has entered the two coaxial metal cylinders and these have been folded upward by the concave curl die face 78 against the anvil provided by member 58 to complete the fastener. The other piston 26 now retracts and the punch 54 and curl die 64 return to the positions of FIG. 4 under the action of the springs 30, allowing the joined sheets to be removed.

It will be understood that the two motors constituted by cylinders 24 and pistons 26, can be operated automatically in the necessary sequence. For example, when the piston rods 26, or the coupling rod 14, reach predetermined upward and downward points they may operate switches that automatically switch supply of liquid from one cylinder to the other. The apparatus can be included in production equipment as a stage thereof together with means for automatically moving the sheet material through the sheet receiving station, the moving means being synchronised with the operation of the motors. A completely portable form may not employ motors at all, the motive power being provided by the human operator, but this will of course limit the thickness of the material that can be joined. A fastening as produced by the described apparatus is illustrated by FIG. 1A and it will be seen that extruded parts of the sheets have been curled completely back to overlay the adjacent portion of the lower sheet 84. Such a fastening is found to have sufficient strength for it to replace currently employed other forms of structural fastening and is equally effective in all directions.

FIGS. 9 through 13 illustrate another embodiment of the invention which permits a much larger gap to be provided between the two members 58 and 68 even though, owing to the limited space available for drawings, the gap illustrated is not much greater than that of the embodiment of FIGS. 1 to 9. The pierce and curl punch 54 is formed in two separate parts comprising the smaller diameter pierce portion 86, and the larger diameter extrusion portion 98, the portion 86 being slidable in a bore in the portion 98.

Figure 11:
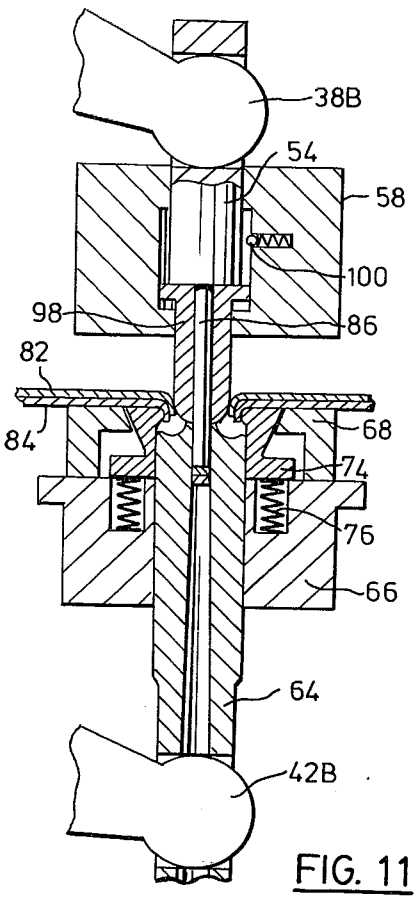
FIGS. 9 through 13 are similar schematic figures to illustrate the successive steps of operation of a second embodiment of the invention.
Figure 10:
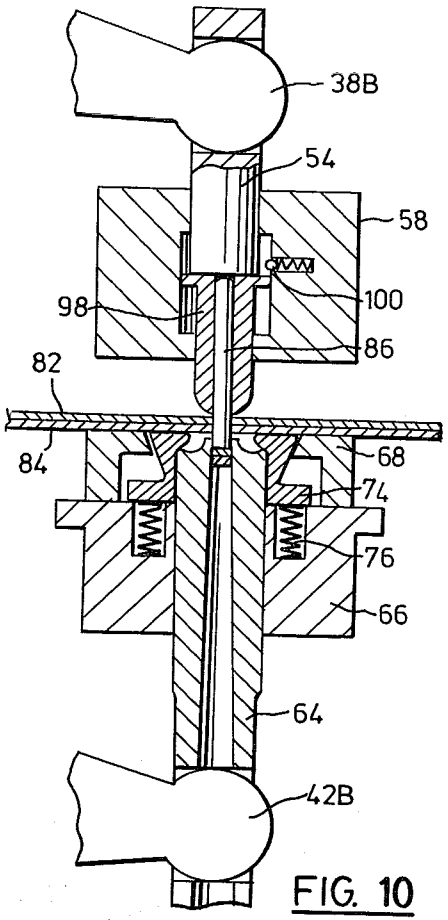
Figure 9:
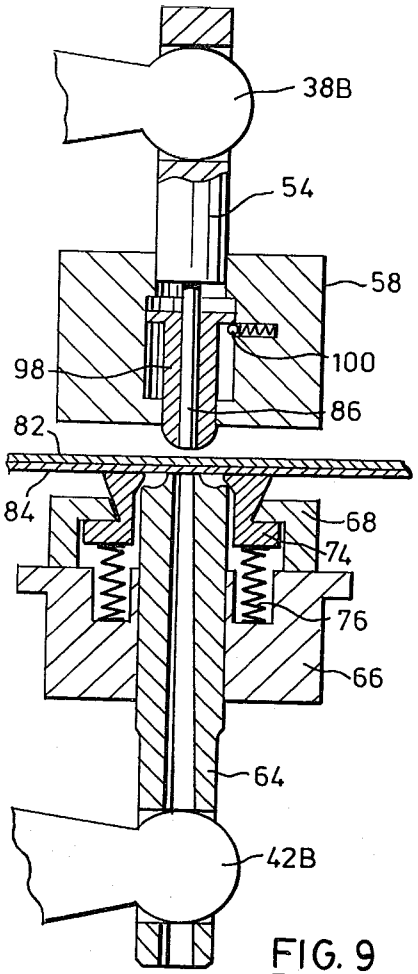
Figure 13:
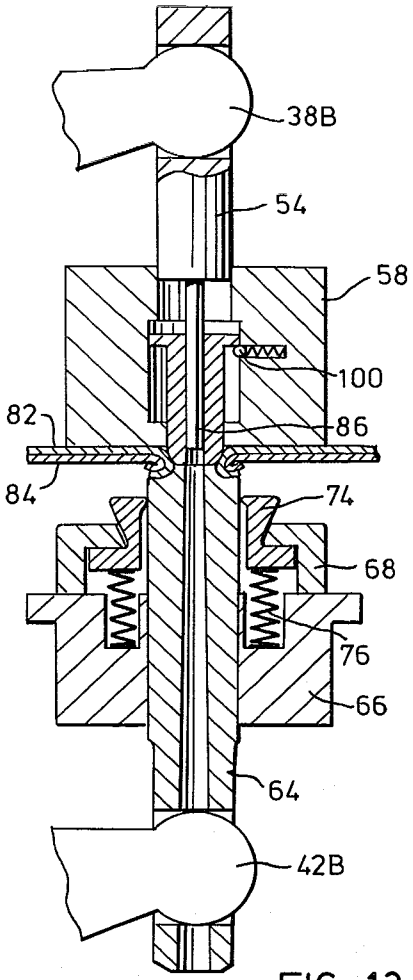
Figure 12:
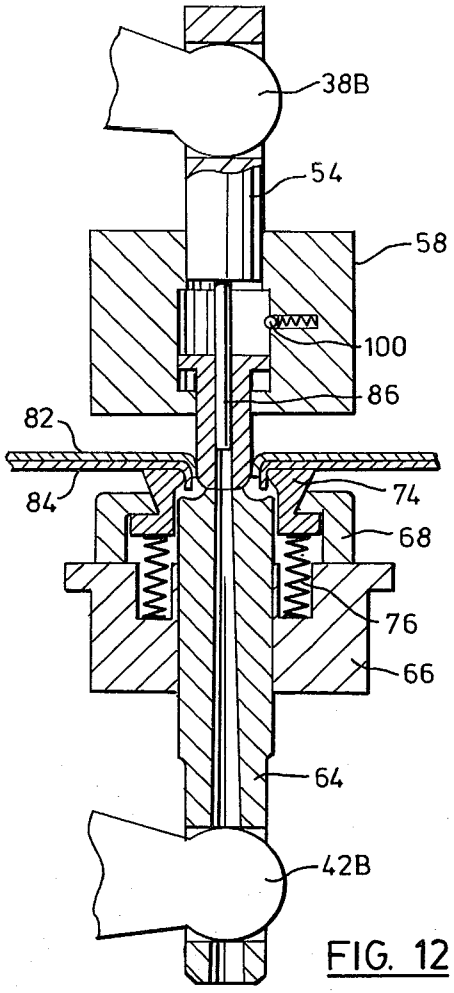

FIG. 10 corresponds to FIG. 4 of the first-described sequence and it will be seen that the punch 54 is in its uppermost position, with the extrusion portion 98 retained in its corresponding position by a spring latch 100. As the punch moves downward the portion 98 is driven down past the latch (FIG. 10) moving with the portion 86 until the latter also is driven through the sheets 82 and 84 to extrude the coaxial cylinders (FIG. 11). Since the portions 86 and 98 are relatively movable the withdrawal of the portion 86 upward (FIG. 12) does not necessarily move the portion 98 upward, and the latter can therefore remain to hold the sheets 82 and 84 accurately centered while they are moved over a considerable gap, until the lower edges of the cylinders are engaged by the curl die 64 to form the fastening.

Figure 14:
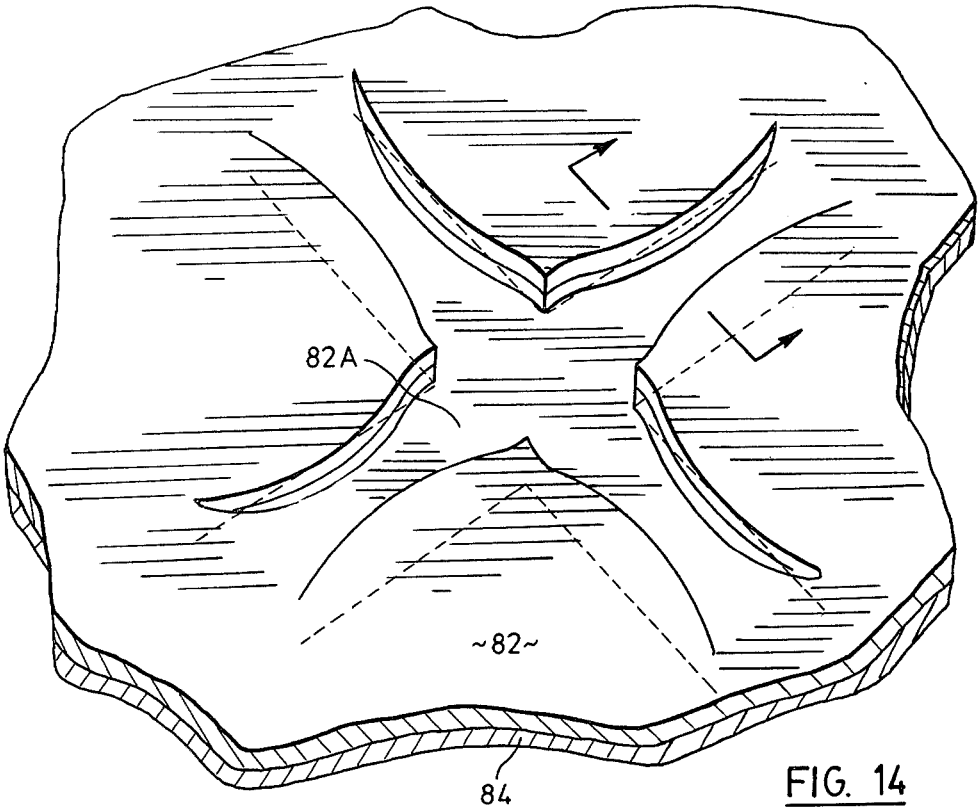
FIG. 14 is a perspective view illustrating another kind of fastening that can be produced by apparatus of the invention constituting a third embodiment.
Figure 15:
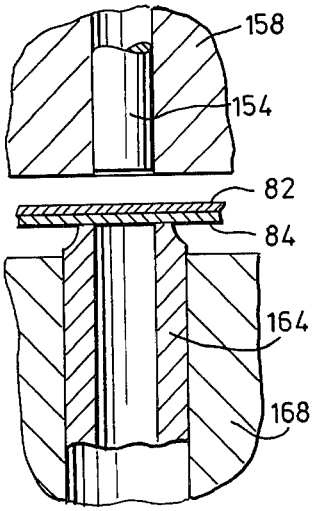
FIGS. 15 through 17 are similar schematic figures to illustrate the successive steps of operation of the third embodiment by which the fastening of FIG. 14 has been formed.
Figure 16:
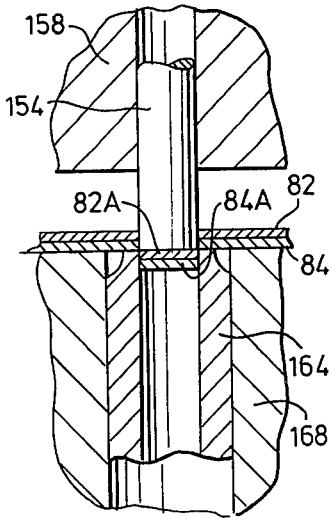
Figure 17:
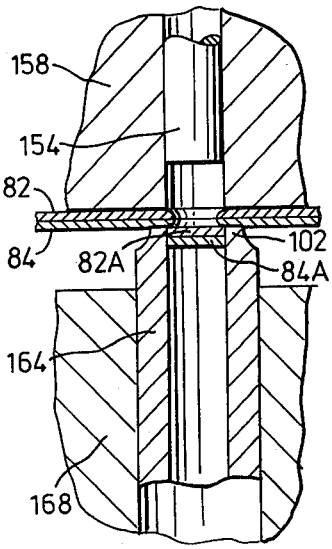

An alternative form of fastening is illustrated by FIG. 14, and the apparatus required to form it, and the sequence of its operation, is illustrated by FIGS. 15 through 17, the cross-section of FIGS. 15 through 17 being taken on the line A—A of FIG. 14. In this embodiment the punch die 154 is of cruciform shape and performs only a punching function without an accompanying extrusion function, the die 164 being of corresponding cooperating shape. FIG. 15 shows the apparatus in its neutral position, while FIG. 16 shows the lowest point of the longitudinal stroke of the punch 154, where the lancing out of curciform-shaped portions 82A and 84A has been completed. As in the preceeding two embodiments the punch 154 travels further and faster than the die 164. At the end of the upward stroke illustrated by FIG. 17 edges 102 of the die member 164 trap and inpact the edges of the sheets 82 and 84 surrounding the cruciform-shaped lance against the stationary anvil provided by the body part 158. At this time the punch 154 has moved completely out of the way and consequently the impacted edges are free to move inwards, trapping the lanced portions 82A and 84A in their new position. Such a connection structure has the advantage over that of FIG. 1A that the sheets are also held against rotation relative to one another.

We claim:

1. Apparatus for the fastening together of two superimposed sheets of material using an integral fastener comprising:

an apparatus body, a punch member mounted by the body for movement along a longitudinal axis toward and away from a sheet receiving station, an extrusion die member of segmented form surrounding the said longitudinal axis for cooperation with the punch member upon engagement of the latter with sheet material at the sheet receiving station to form the engaged portion of the sheet material to a cylindrical formation, a curl die member mounted by the body for movement along the said longitudinal axis toward and away from the sheet receiving station and engageable with the said cylindrical formation to curl the sheet portions back toward the adjacent sheet and thereby form a fastening between them, movement of the curl die member to curl the cylindrical formation being accompanied by movement of the extrusion die member to an inoperative position, and the curl die member being engageable with the segmented die member upon its movement for curling the cylindrical formation to move the segments radially outward to an inoperative position, and means for moving the punch member into engagement with the sheet material and for moving the curl die member into engagement with the cylindrical formation subsequent to the said engagement of the punch member.

2. Apparatus as claimed in claim 1, wherein the circumference of the curl die member is engageable with a radially-inwardly protruding nose of the segmented die member to move the segments thereof radially outward.

3. Apparatus as claimed in claim 1, wherein the said punch member comprises a nose portion of smaller diameter for piercing the sheet material and a forming portion of larger diameter for extruding the portion of the sheet material to be a cylindrical formation, and the said curl die member includes a bore serving as a piercing die that is entered by the pierce punch member nose portion during the piercing operation.

4. Apparatus as claimed in claim 1, wherein the said moving means move the punch and curl die members simultaneously, the moving means moving the curl die member away from the sheet receiving station as it moves the punch member toward the station, and vice versa.

5. Apparatus as claimed in claim 4, wherein the said moving means moves the punch member toward and away from the sheet receiving station at a faster rate and with a greater excursion than it moves the curl die member toward and away from the sheet receiving station.

6. Apparatus as claimed in claim 5, wherein the said moving means comprise a first lever pivoted about a respective first axis and connected to the punch member, a second lever pivoted about a respective second axis and connected to the curl die member, and a coupling connecting the said first and second levers for simultaneous movement.

7. Apparatus as claimed in claim 6, wherein the first and second levers are of the same length and the said first pivot axis is spaced farther from the connection of the first lever to the punch member than is the second pivot axis from the connection of the second lever to the curl die member.

8. Apparatus as claimed in claim 1, wherein said moving means comprise:

a first motor means moving the punch member toward and through the sheet receiving station while it moves the curl die member away from the sheet receiving station, and a second motor means moving the punch member away from the sheet receiving station while it moves the curl die member toward and through the sheet receiving station.

9. Apparatus as claimed in claim 8, wherein each of the said motor means comprises a hydraulic cylinder and piston and a cooperating return spring.

10. Apparatus as claimed in claim 8, and including two opposed adjustable compression springs connected between the punch and curl die members and the apparatus body and returning them to a neutral position in the absence of operation of the said motors.

11. Apparatus as claimed in claim 1, wherein the said punch member comprises a nose portion of smaller diameter for piercing the sheet material and a separate forming portion of larger diameter for extruding the portion of the sheet material to a cylindrical formation, the nose portion being movable independently of the forming portion in a bore in the latter, and the said curl die member includes a bore serving as a piercing die that is entered by the pierce punch member nose portion during the piercing operation.

12. Apparatus as claimed in claim 1, including spring means urging the segmented die member to its inoperative position.

13. Apparatus for the fastening together of two superimposed sheets of material using an integral fastener comprising:

an apparatus body, a punch member mounted by the body for movement along a longitudinal axis toward and away from a sheet receiving station, an extrusion die member of segmented form surrounding the said longitudinal axis for cooperation with the punch member upon engagement of the latter with sheet material at the sheet receiving station to form the engaged portion of the sheet material to a cylindrical formation, a curl die member mounted by the body for movement along the said longitudinal axis toward and away from the sheet receiving station and engageable with the said cylindrical formation to curl the sheet portions back toward the adjacent sheet and thereby form a fastening between them, movement of the curl die member to curl the cylindrical formation being accompanied by movement of the extrusion die member to an inoperative position, and means for moving the punch member into engagement with the sheet material and for moving the curl die member into engagement with the cylindrical formation subsequent to the said engagement of the punch member, wherein the extrusion die member is operative in a bore in the apparatus body, the die member segments and the bore having cooperating radially-acting cam faces to move the segments radially inwards to an operative position as the punch member moves along the longitudinal axis toward the sheet receiving station.

14. Apparatus for the fastening together of two superimposed sheets of material using an integral fastener comprising:

an apparatus body, a punch member mounted by the body for movement along a longitudinal axis toward and away from a sheet receiving station, an extrusion die member surrounding the said longitudinal axis for cooperation with the punch member to lance registering portions from the superimposed sheets upon engagement of the latter with sheet material at the sheet receiving station to form the engaged lanced portion of the sheet material to a depressed formation, the extrusion die member being engageable thereafter with the sheet material adjacent the said lanced depressed portion to extrude the said adjacent portions over the lanced depressed portions and thereby form a fastening between them, and means for moving the punched member into engagement with the sheet material and for moving the extrusion die member into engagement with the sheet material subsequent to the said engagement of the punch member, wherein the said moving means move the punch and extrusion die members simultaneously, the moving means moving the extrusion die member away from the sheet receiving station as it moves the punch member toward the station, and vice versa, and wherein the said moving means moves the punch member toward and away from the sheet receiving station at a faster rate and with a greater excursion than it moves the extrusion die member toward and away from the sheet receiving station.

15. Apparatus as claimed in claim 14, wherein the said moving means comprise a first lever pivoted about a respective first axis and connected to the punch member, a second lever pivoted about a respective second axis and connected to the extrusion die member, and a coupling connecting the said first and second levers for simultaneous movement.

16. Apparatus as claimed in claim 15, wherein the first and second levers are of the same length and the said first pivot axis is spaced farther from the connection of the first lever to the punch member than is the second pivot axis from the connection of the second lever to the extrusion die member.

17. Apparatus as claimed in claim 14, wherein said moving means comprise:

a first motor means moving the punch member toward and through the sheet receiving station while it moves the extrusion die member away from the sheet receiving station, and a second motor means moving the punch member away from the sheet receiving station while it moves the extrusion die member toward and through the sheet receiving station.

18. Apparatus as claimed in claim 17, wherein each of the said motor means comprises a hydraulic cylinder and piston and a cooperating return spring.

19. Apparatus as claimed in claim 17, and including two opposed adjustable compression springs connected between the punch and extrusion die members and the apparatus body and returning them to a neutral position in the absence of operation of the said motors.

* * * * *